United States Patent [19]

Hydro

[11] 4,158,457

[45] Jun. 19, 1979

[54] JUMP ROPE HANDLES

[76] Inventor: Paul J. Hydro, 202 Ridge Ave., Kennett Square, Pa. 19348

[21] Appl. No.: 856,115

[22] Filed: Nov. 30, 1977

[51] Int. Cl.[2] ..... A63B 5/20

[52] U.S. Cl. ..... 272/75

[58] Field of Search ..... 272/75, 74, 68, 67, 272/133, 143; 16/110 R, 110.5, 114 R, 114 B, 115; 49/460; 220/94 R, 94 B, 96; 46/25, 28, 60; 24/208 R, 208 A, 230 R, 213 R

[56] References Cited

U.S. PATENT DOCUMENTS

| | | | |
|---|---|---|---|
| 195,400 | 9/1877 | Richard | 24/208 R |
| 364,312 | 6/1887 | Sipe | 24/208 R |
| 369,123 | 8/1887 | Peters | 24/208 R |
| 674,431 | 5/1901 | Black | 272/75 |
| 924,104 | 6/1909 | Powell | 24/230 R |
| 2,947,053 | 8/1960 | Sanderson | 46/25 UX |
| 2,972,833 | 2/1961 | La Grutta | 46/25 |
| 3,138,895 | 6/1964 | Gausewitz | 46/25 X |
| 3,189,069 | 6/1965 | Stowell | 16/110 R X |
| 3,192,738 | 7/1965 | Charles et al. | 46/25 X |
| 3,330,558 | 7/1967 | Simons, Jr. | 272/68 |
| 3,363,898 | 1/1968 | Crovello | 272/75 |
| 3,452,452 | 7/1969 | Dore | 46/23 X |
| 3,475,023 | 10/1969 | Fauvelle | 272/75 |
| 3,778,053 | 12/1973 | Smith et al. | 272/75 |
| 4,007,931 | 2/1977 | Wich et al. | 272/75 |
| 4,018,441 | 4/1977 | Greenberg | 272/75 |

FOREIGN PATENT DOCUMENTS

| | | | |
|---|---|---|---|
| 140303 | 2/1951 | Australia | 16/110 R |
| 70016 | 7/1893 | Fed. Rep. of Germany | 272/75 |
| 1507343 | 11/1967 | France | 272/75 |
| 164848 | 9/1958 | Sweden | 272/75 |
| 341612 | 11/1959 | Switzerland | 16/110.5 |

OTHER PUBLICATIONS

Gerber Toy Line Catalog, 1966, Pop-Em Alphabet Blocks.

*Primary Examiner*—Richard T. Stouffer
*Assistant Examiner*—Arnold W. Kramer
*Attorney, Agent, or Firm*—Robert Jacobs

[57] ABSTRACT

The invention discloses male and female handles for jump ropes or skip ropes which allow connection of two or more jump ropes to form ropes of varying lengths. Thus with only one type of rope all forms of rope exercise can be performed including joint turning, Chinese jump rope etc. The invention also discloses stationary mounts which are used to attach one handle or the other handle so that two participants can participate in multiple jump rope exercises.

7 Claims, 6 Drawing Figures

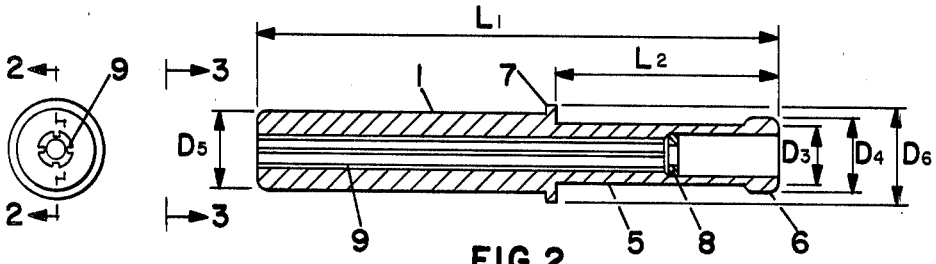
FIG. 3
FIG. 2
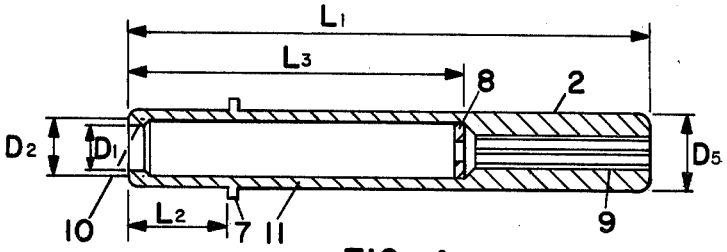
FIG. 4
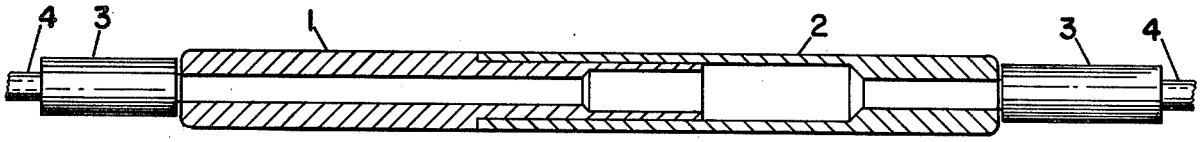
FIG. 1
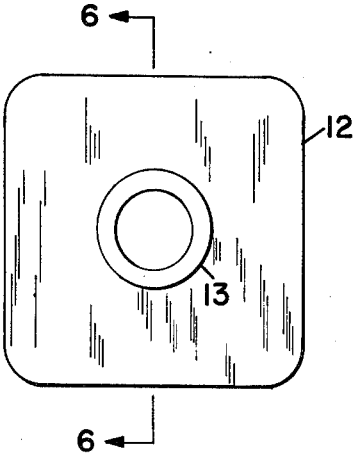
FIG. 5
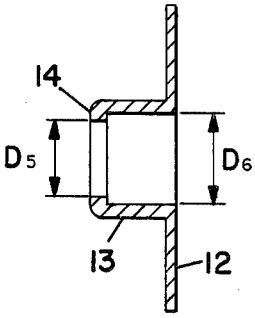
FIG. 6

JUMP ROPE HANDLES

This invention relates to an improved handle for jump or skip ropes which enables one to connect multiple lengths of said ropes to accommodate the various activities one engages in when using skip and jump ropes. The invention also relates to a means whereby two individuals can use one jump rope, one turning the rope while the other jumps.

Jump ropes used heretofore have consisted of a flexible cord. The flexible cord may be used with or without handles; may or may not be encased with plastic cylinders (see U.S. Pat. No. 3,642,277 for a disclosure of this variation of flexible cord) for attractiveness and avoidance of wear of the flexible member. The jump or skip rope will usually come on one short length for an individual person to use; it will come in a double or triple length, as compared to the single rope, for use by a group of people where two individuals will turn the rope with one or more individuals jumping or skipping rope to their cadence. It can also come with ball-bearing handles and other types of handles to aid the person in gripping the rope. Other types of jump ropes include the Chinese jump rope, which is a long continuous loop of rope held by two people and utilized for the Chinese jump rope cadence.

It is the object of this invention to provide a handle for a jump rope which has the facility to connect to other handles on similar jump ropes, extending the rope by multiple lengths of the smaller unit.

It is another object of this invention to provide a jump rope with a handle and a compatible plug for fastening to upright surfaces so that one person can turn a jump rope for another person without the necessity of three people being present. It is another object of this invention to provide jump ropes which may be connected and used to fence off an area, utilizing the plugs as ends.

The following patent applications are the most pertinent art known to the applicant:

U.S. Pat. No. 3,517,931 to J. B. Kaliss which contains the concept of a convertible rope. Unlike applicants' it is a double rope used in single or double strands.

U.S. Pat. No. 3,475,023 to R. M. Fouville which discloses a sectional skip rope and is thus close to applicants invention; and U.S. Pat. No. 2,723,121 to Cartwright, et al. which contains a disclosure of an adjustable jump rope.

As indicated, this invention relates to handles for jump ropes and, specifically, handles which have the ability of attaching and detaching one rope to another or the same rope to itself. Because of this ability, with a single rope, one may form a hoop or a small Chinese jump rope; one may use it for single jumping; one may use it, together with the plug, for turning for a second individual jumping. Although the handles may be any cross-sectional shape, so long as the largest dimension of a cross-section is no bigger than about 3 inches, it is preferable that the handles be cylindrical for ease of gripping.

The handles of this invention are shown in FIGS. 1 through 4.

FIG. 1 is a view of a male handle, 1, and a female handle, 2, in a connected configuration. The handles are shown as cylindrical, which is the preferred shape. Items 4 and 3, FIG. 1, are respectively the flexible member for jump rope and the plastic encasement which can be used to decorate the rope as described in U.S. Pat. No. 3,642,277.

FIG. 2 is a cross section of a preferred male handle. It shows a greater detail of the handle and in fact, the preferred handle. This figure depicts a reduced surface, 5, in the male handle, a lip on the external edge of these handles, 6, a stop, 7, and a seat, 8.

FIG. 3 is a side view of the male handle depicted in FIG. 2. It shows a ribbing, 9, on the internal surface of the male handle when this handle is hollow or tubular. This ribbing is to allow for additional strength.

FIG. 4 is the preferred female handle. It contains a tubular portion around which there is a core wall 11; this core wall has a lip, 10, protruding from it downward continuously attached to the core wall at its end or front. The female handle has a seat, 8, and stop, 7. The stop is at an identical distance from the front of the female handle as the stop is on the male handle, as depicted in FIG. 2.

In FIGS. 2 and 4 the distance, L2, between the front of the female or male handle and the stop is shown as different. This is merely to indicate that the measurement may vary; however, in any set of handles the distance is identical.

FIG. 5 is a front view of the plug, consisting of a flange, 12, a hub, 13, and a lip, 14.

FIG. 6 is a sectional view of the plug giving greater detail to the internal portion of the hub which is hollow.

Referring to FIG. 2, which details the preferred male handle, one can understand that the basic handle of this invention comprises the following: an outer surface of the handle the widest dimension of which, D5 not counting stop 7 is usually no greater than about three inches nor less than about 0.25 inches and preferably is between about 0.5 inches and about 1.75 inches. The external surface has a length, L1, of usually between about 2 to about 7 inches. For a distance, L2, which is usually no less than ¼ of an inch up to about 50% of the total length of the handle, the handle has a reduced surface so that its external dimensions are from about 0.1 to about 0.25 inches less than the D5. The reduced external surface, 5, has at its end a lip or ridge protruding therefrom, 6, which is about 0.05 inches in height above the reduced surface. The cross sectional area of the male handle may be rectangular, square, triangular, octagonal or circular, as long as the maximum width or depth dimension is as indicated above. To facilitate handling and to prevent the handle from being too heavy, it is preferable that it be tubular or hollow. The word "tubular" is not meant to connote a circular cross section but is merely meant to demonstrate that the handle is hollow or is a geometric shape with a continuous external wall and a hollow core. The wall thickness of the handle is variable but it should be such that when the rope is in use the handle does not easily deform. Although the materials of construction of the handle are not crucial, the handles may be constructed from plastics such as polyethylene or polypropylene or nylon, rubber, synthetic elastomers, metal or even a stiff knitted fabric. The only requirement is that the handle be a stiff material which will provide a grip for turning the jump rope. The preferred material is a light density plastic.

As indicated above, the preferred male handle is depicted in FIGS. 2 and 3. In addition to the basic portions of the invention described above, the preferred handle will also have a stop, 7, which will have a multiple function. The stop will start at the point where the reduced surface of the male handle ends and will rise approximately 0.005 to 0.01 inches above the external surface and form a continuous band of the same shape as the handle around the handle at that point. The width of the stop, as shown in FIG. 2 is small usually within the range of 0.001 to 0.01 inches. In addition to the stop, the preferred handle has a seat, within the interior of the handle. The seat is a continuous smooth surface with a hole therethrough. It is utilized as a base for a knot in a flexible member which rests upon the seat. The seat thereby allows swivelling of the knot within the handle in the hollow core depicted in FIG. 2. Below the seat the interior of the male handle is ribbed, 9, for added strength. This ribbing is depicted in both FIGS. 2 and 3. The preferred handle as shown in FIGS. 2 and 3 and discussed above is cylindrical in shape for easy gripping although an octogonal or polygonal shape approaching the circle is of equal utility.

The female handle of this invention compromises an external surface, which surface is no more than about 3 inches and no less than about 0.25 inches in dimension. As with the male handle, the cross sectional area may be rectangular, square, hexagonal, octagonal or circular or irregular, with the circular cross sectional area being preferable. The female handle is a tube and this tube section exists for at least ¼ of an inch to about 75% of the entire length of the female handle. The overall length of the female handle is from 2 to 7 inches. The tube portion, called the core section, of the female member must be of identical shape as the reduced end of the male handle and its internal dimension, D2, must be such that the male handle once inserted will slide into the female handle and engage it. The leading edge of the core section has a lip attached thereto continuously and protruding into the core section for about 0.05 inches. The wall of the core section may be from 0.1 to about 0.5 inches in thickness so long as its internal dimension is sufficiently large and properly shaped to engage the reduced surface of the male handle and not be so open as to allow the male handle to slip therefrom. The lip on the male handle and female handle add to the difficulty of the handles coming apart without sufficient force being exerted. Thus, during rope-turning, the two ropes should remain joined but upon a tug would come apart. The core wall must be sufficiently thick to resist deformation and fracture when the handle is in use and is not mated with the male handle. The remaining part of the female handle beyond the core section may be solid or hollow and in most instances will have an opening sufficient to allow the flexible member to pass through and be secured within the core section. The remaining portion of the female handle, if hollowed to form a tubular shape, should be ribbed to add rigidity and to strengthen the handle. The cross-sectional area of the female handle will be identical to the male handle it is utilized with and will vary from about 0.25 to 1.75 inches.

As indicated, the female handle shown in FIG. 4 is the preferred embodiment of this invention. This handle is fitted with a seat, 8, where again a knotted flexible member will rest so that its knot can swivel within the handle and aid in the utilization of the rope. It will also have a stop, item 7, at a distance from its front section equal to the distance that the stop is from the end of the reduced surface of the male handle. It is noted that although the distances L2 in FIGS. 2 and 4 are dissimilar, it is only for illustrative impact that these distances do not necessarily remain constant in all pairs of handles. However, in any pair of handles which are sold compatibly, L is identical. This stop is of the same dimensions and configuration as the male handle's stop. The stop, on both male and female handle, is utilized to allow connection of the male and/or female handle with the plug when the jump rope is used with the plug as described in this specification. The preferable cross-sectional area is circular for the female handle as for the male handle. The materials of construction of a particular female handle would be identical to those of the male handle in use with it.

The male handle and the female handle are joined to the ends of a flexible member so that the reduced external surface and the core section are facing away from the end of the flexible member, such as a rope. The rope can be fastened to the handles by glue, staples, knots, hooks or any other convenient means.

The plug of this invention, as shown in FIGS. 5 and 6, is used as a stationary mount so that the male or female handle can be engaged therein. The plug consists of a back flange, 12, which may be fastened to a stationary object by fastening means such as screws, glue or other means. The hub, 13, is hollow, with its internal cross-section compatible with the external cross-section of either handle. The hollow cross-section is such that it is compatible with a male or female handle when it is placed within the hollow hub. In the preferred embodiment illustrated in FIGS. 5 and 6, the hub dimension D6 is of the same dimension as the stop of the handles with D5 equalling the diameter of the external surface of the handles. When the male or female handle is engaged with the hub's hollow core, it enables one person standing away from the secured plug to turn the rope for other individuals in a skipping or jumping game. The hub will usually have a flange which is no more than about 3 or 4 inches in its largest dimension, and the hub is usually no more than 5 inches in height above the flange. The minimum dimension depends upon the handle length. The external dimension of the hub is usually less than the flange, although it can be almost equal to the flange, or even merge with the flange if no distinction between the flange and the hub is desired. It is preferable to have the hub of a smaller dimension to save material and weight, and yet still have a sufficient surface to securely attach the plug to a stationary object, such as a wall, a gate, a railing, etc. The hub is continuously attached to the flange and is usually made from one molded piece of plastic.

When the skip ropes of this invention are joined together to form a large circle one has a Chinese jump rope for utilization in the jumping cadence of the Chinese jump rope. Although particular dimensions and handles are shown, the basic concept of the invention which is claimed herein, is the quick-connect means of the smaller external surface of a portion of one handle, inserting into the hollow core of another handle with mating configurations to form a quick connect between either the end of the jump rope or a multiple series of jump ropes. Although particular connecting means are depicted other means such as hooks or snaps are contemplated.

Having thus described my invention, I claim:

1. Handles for a jump rope comprising two elongated handles with a length substantial enough to provide a gripping area constructed from a stiff material wherein each handle has means for attaching the end of a jump rope thereto on the back end of each handle; one handle being a male handle and having on the front end a reduced portion of said length resulting in a reduced portion and a non-reduced portion of said handle and said reduced portion at the tip thereof being raised to form a lip which is still smaller than the non-reduced portion of said male handle; the second handle being a female handle and containing on the front end a hollow core section portion, and said hollow portion having at its tip an inwardly protruding lip reducing the opening of the hollow portion of said female handle wherein the hollow portion beyond the inwardly protruding lip is identical in shape and slightly larger in dimensions than the raised lip of the male handle; and the inwardly protruding lip of the female handle and the raised lip of the male handle forming a resilient snap fit so that, when the reduced portion of the male handle and the hollow portion of the female handle are placed together, they are difficult to take apart; and so that, when said handles are affixed to a jump rope, a male and female handle is attached to a respective end of said jump rope allowing the attachment of each rope to itself to form a circle and to other handles and said reduced portion of the male handle and the hollow portion of the female handle being compatible to insert the reduced portion of the male handle into the female handle's hollow core section portion.

2. Handles in accordance with claim 1 wherein the cross-section of each handle is circular and wherein the reduced portion surfaces of the male handle and the core section of the female handle are circular in cross-section.

3. Handles in accordance with claim 2 wherein the handles are hollow and contain ribs on the internal surface for extra strength in the non-core section of the female handle and in the non-reduced portion of the male handle.

4. Handles in accordance with claim 1 wherein a stop is provided which protrudes perpendicularly from the forward surface of the non-reduced portion of the male handle and a similar stop is provided on the female handle of identical shape and size located at a distance from the front of the female handle equal to the distance the stop of the male handle is located from the front of the male handle.

5. Handles in accordance with claim 4 wherein within each handle is a seat comprising a shoulder for a knot to rest on so that when a flexible member is threaded into the handle and secured by a knot, the knot rests on the shoulder and swivels within the handle.

6. The structure of claim 4 in combination with a plug which comprises a flange continuously attached to a hub of lesser dimension wherein said hub is hollow and has protruding at its tip away from the flange an inwardly projecting lip reducing the opening of the hollow hub which is compatible with the stops of said handles and results in a snap fit with either of said handles whereby either handle can be snap fitted to said hub which plug when fixed to a vertical surface by its flange permits the jump rope to be turned by one individual holding the handle opposite the handle snap fitted to the hub of the plug.

7. Handles for a jump rope in accordance with claim 1, wherein said handles are circular in cross section and hollow for their length forming an interior surface and said means attaching a jump rope thereto consists of shoulders on the hollow back portion of the male and female handle for attaching the rope which hollow back portions contain ribbings on the interior surface thereof; and a stop is provided which protrudes perpendicularly from the outer front surface of the non-reduced portion of the male handle and an identical stop on the female handle located an equal distance from the front of the female handle as the stop is located from the front end of the male handle.

* * * * *